US011165179B2

(12) United States Patent
Komoto et al.

(10) Patent No.: US 11,165,179 B2
(45) Date of Patent: Nov. 2, 2021

(54) CONNECTOR AND CONNECTING METHOD

(71) Applicant: Japan Aviation Electronics Industry, Limited, Tokyo (JP)

(72) Inventors: Tetsuya Komoto, Tokyo (JP); Seiya Matsuo, Tokyo (JP); Akihiro Matsunaga, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/897,831

(22) Filed: Jun. 10, 2020

(65) Prior Publication Data

US 2021/0075135 A1 Mar. 11, 2021

(30) Foreign Application Priority Data

Sep. 9, 2019 (JP) ..... JP2019-163642

(51) Int. Cl.
*H01R 12/77* (2011.01)
*H01R 4/50* (2006.01)

(52) U.S. Cl.
CPC ..... *H01R 12/778* (2013.01); *H01R 4/5083* (2013.01); *H01R 12/771* (2013.01); *H01R 12/777* (2013.01)

(58) Field of Classification Search
CPC ..... H01R 4/5083
USPC ..... 439/496
See application file for complete search history.

(56) References Cited

U.S. PATENT DOCUMENTS 7,445,496 B2 * 11/2008 Kao ..... H01R 4/5083 439/496
8,616,905 B2 12/2013 McGregor et al.
2018/0233854 A1 8/2018 Komoto et al.

FOREIGN PATENT DOCUMENTS

EP 3494820 A1 6/2019
JP 2018129244 A 8/2018

OTHER PUBLICATIONS

European Search Report issued to the corresponding EP20187444.3 dated Oct. 28, 2020.

* cited by examiner

*Primary Examiner* — Ross N Gushi
(74) *Attorney, Agent, or Firm* — Muncy, Geissler, Olds & Lowe, P.C.

(57) ABSTRACT

A connector includes a pushing member including a projection and a pushing member-side flange formed at a root portion of the projection, and a contact having a projection accommodating portion, the pushing member-side flange including a pair of fixing portions separately arranged on opposite sides of the root portion of the projection across the projection, when the projection is inserted into the projection accommodating portion together with the flexible conductor with a part of the flexible conductor being laid along a lateral surface of the projection being fixed by the pair of fixing portions, the part of the flexible conductor laid along the lateral surface of the projection being sandwiched between the lateral surface of the projection and an inner surface of the projection accommodating portion to contact the inner surface of the projection accommodating portion, whereby the contact is electrically connected to the flexible conductor.

9 Claims, 10 Drawing Sheets

FIG. 6
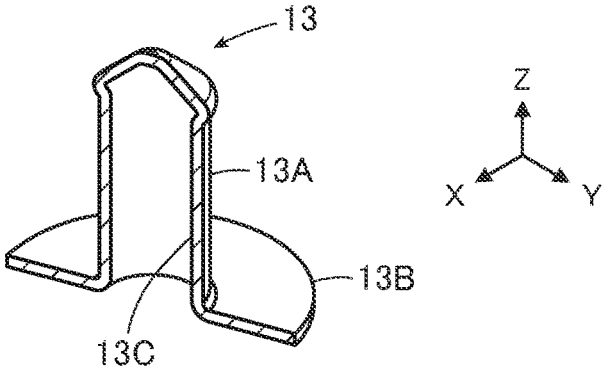
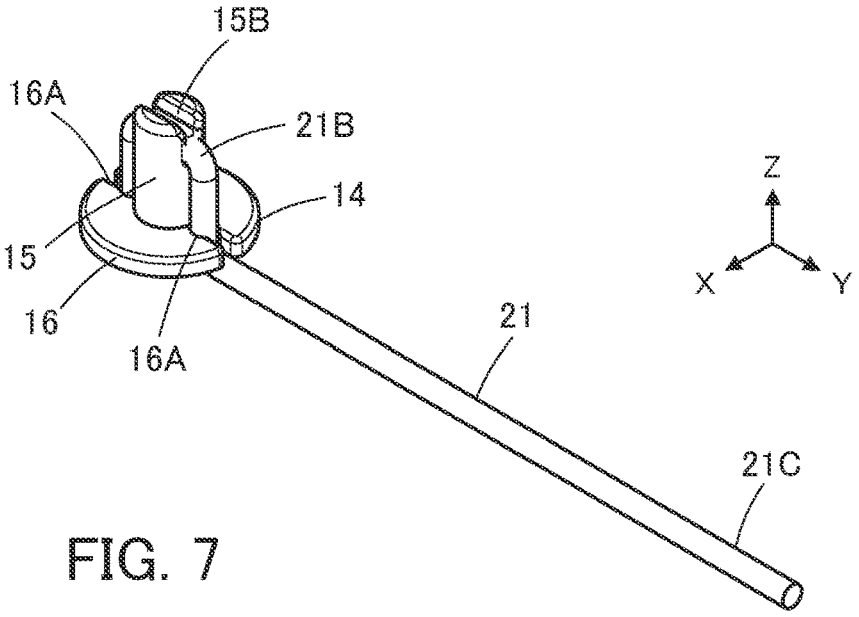
FIG. 7
FIG. 8
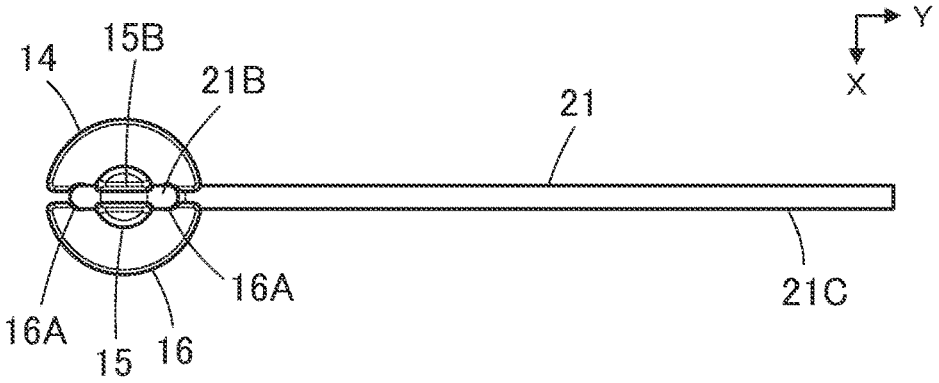

FIG. 21
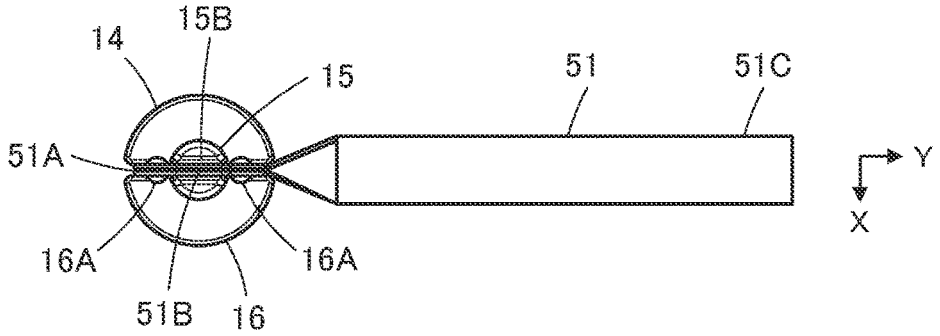
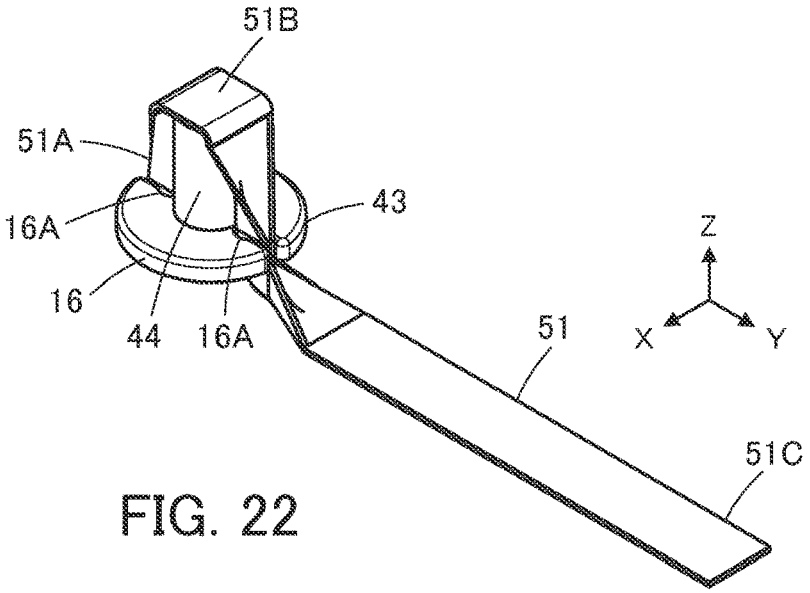
FIG. 22
FIG. 23
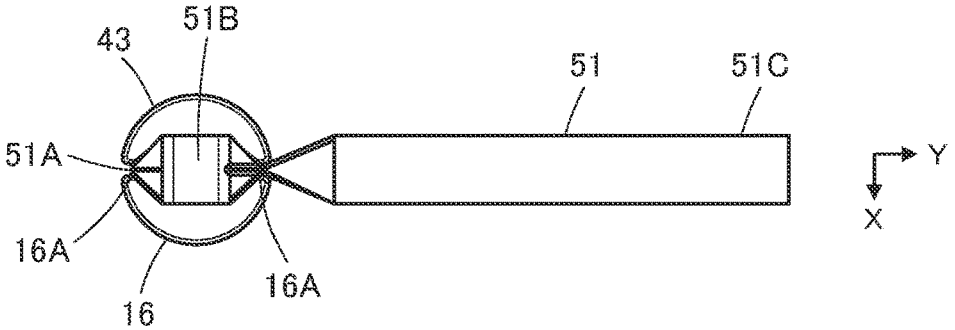

CONNECTOR AND CONNECTING METHOD

BACKGROUND OF THE INVENTION

The present invention relates to a connector and a connecting method, particularly to a connector connected to a flexible conductor.

As a connector connected to a flexible conductor, for instance, JP 2018-129244 A discloses a connector shown in FIG. 26. This connector includes a contact 2 and a base member 3 that are disposed on the opposite sides across a flexible substrate 1 to sandwich the flexible substrate 1 therebetween.

A flexible conductor 4 is exposed on the flexible substrate 1 on the side facing the contact 2, the contact 2 has a projection accommodating portion 5 of concave shape formed to face the flexible conductor 4, and a projection 6 is formed on the base member 3 to project toward the bottom of the flexible substrate 1. When the projection 6 of the base member 3 is, together with the flexible substrate 1, inserted into the projection accommodating portion 5 of the contact 2 with the flexible substrate 1 being sandwiched between the projection 6 and the contact 2 such that the projection 6 is covered with the flexible substrate 1, the flexible substrate 1 is pressed against the inner surface of the projection accommodating portion 5 of the contact 2 by the projection 6, and the inner surface of the projection accommodating portion 5 makes contact with the flexible conductor 4 exposed on the surface of the flexible substrate 1 accordingly, whereby the contact 2 is electrically connected to the flexible conductor 4.

Meanwhile, when the projection 6 of the base member 3 is inserted, together with the flexible substrate 1, into the projection accommodating portion 5 of the contact 2, the flexible substrate 1 readily moves relative to the projection 6, causing a problem that the connection process of connecting the connector comprising the contact 2 and the base member 3 to the flexible conductor 4 becomes difficult.

In particular, when the flexible conductor 4 has a width shorter than that of the projection 6, the projection 6 and the flexible conductor 4 need to be inserted into the projection accommodating portion 5 of the contact 2 while their relative position where the flexible conductor 4 extends across a top of the projection 6 is maintained, which makes the connection process of connecting the connector to the flexible conductor 4 more difficult. In addition, if the flexible conductor 4 moves off from the position relative to the projection 6, reliability of electrical connection between the flexible conductor 4 and the contact 2 may be impaired.

SUMMARY OF THE INVENTION

The present invention has been made to solve the foregoing problem and aims at providing a connector that can be readily connected to a flexible conductor and can ensure the reliability of electrical connection to the flexible conductor.

The present invention also aims at providing a connecting method for electrically connecting a contact to a flexible conductor with ease.

A connector according to the present invention is a connector to be connected to a flexible conductor, the connector comprising:

a pushing member including a projection and a pushing member-side flange formed at a root portion of the projection; and a contact made of a conductive material and having a projection accommodating portion of a recess shape into which the projection is inserted, wherein the pushing member-side flange includes a pair of fixing portions separately arranged on opposite sides of the root portion of the projection across the projection and used to fix the flexible conductor, and wherein, when the projection is inserted into the projection accommodating portion of the contact together with the flexible conductor with a part of the flexible conductor being laid along a lateral surface of the projection which adjoins the pair of fixing portions and being fixed by the pair of fixing portions, the part of the flexible conductor laid along the lateral surface of the projection is sandwiched between the lateral surface of the projection and an inner surface of the projection accommodating portion to contact the inner surface of the projection accommodating portion, whereby the contact is electrically connected to the flexible conductor.

A connecting method according to the present invention is a connecting method for connecting a contact to a flexible conductor, the method comprising:

fixing a part of the flexible conductor to a pair of fixing portions arranged on opposite sides of a root portion of a projection of a pushing member with the part of the flexible conductor being laid along a lateral surface of the projection; and inserting the projection into a projection accommodating portion of a recess shape of the contact together with the flexible conductor, whereby, the part of the flexible conductor laid along the lateral surface of the projection is sandwiched between the lateral surface of the projection and an inner surface of the projection accommodating portion to contact the inner surface of the projection accommodating portion, whereby the contact is electrically connected to the flexible conductor.

BRIEF DESCRIPTION OF THE DRAWINGS

FIG. 6 is a cross-sectional perspective view showing a contact used in the connector according to Embodiment 1.

FIG. 7 is a perspective view showing the pushing member to which a flexible conductor is disposed in Embodiment 1.

FIG. 8 is a plan view showing the pushing member to which the flexible conductor is disposed in Embodiment 1.

FIG. 21 is a plan view showing the pushing member to which the flexible conductor is disposed in Embodiment 3.

FIG. 22 is a perspective view showing a pushing member to which a flexible conductor is disposed in a variation of Embodiment 3.

FIG. 23 is a plan view showing the pushing member to which the flexible conductor is disposed in the variation of Embodiment 3.

DETAILED DESCRIPTION OF THE INVENTION

Embodiments of the present invention are described below with reference to the accompanying drawings.

Embodiment 1

Figure 1:
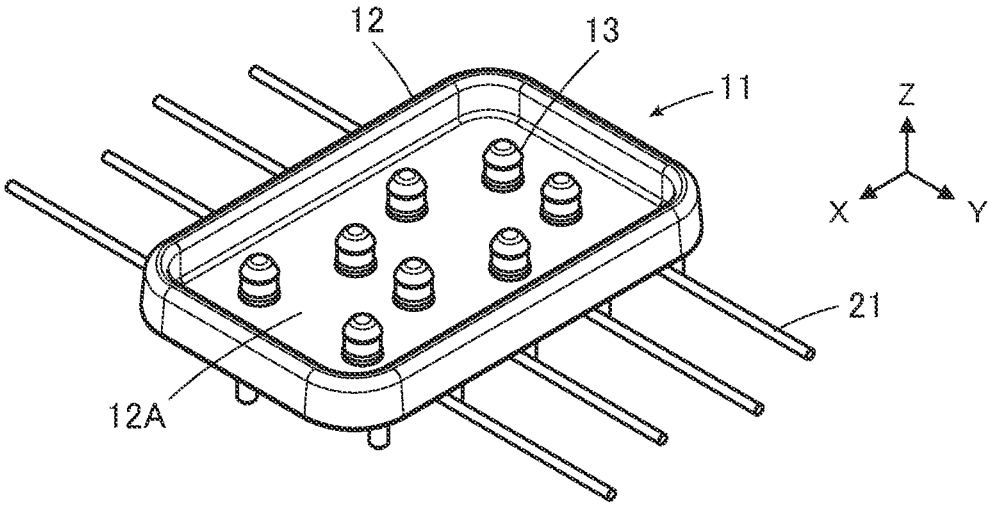
FIG. 1 is a perspective view showing a connector according to Embodiment 1 of the present invention when viewed from an obliquely upper position.
Figure 2:
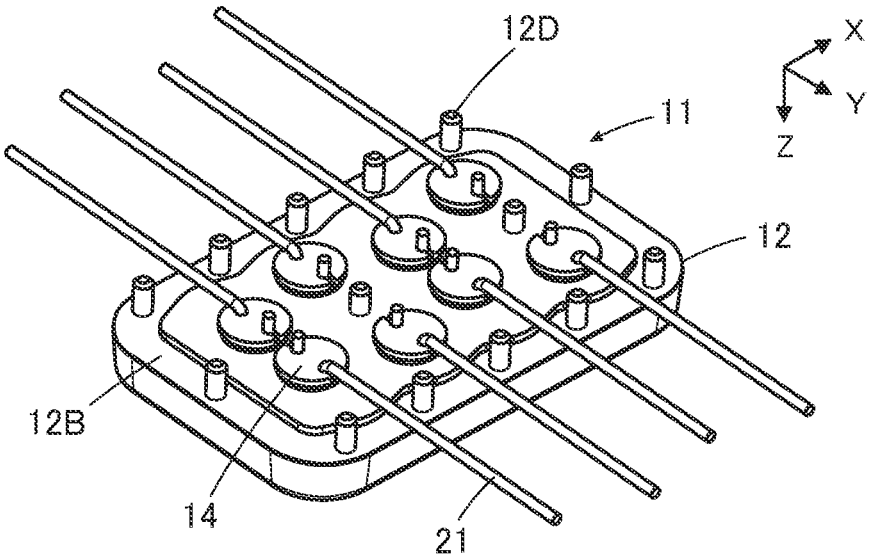
FIG. 2 is a perspective view showing the connector according to Embodiment 1 when viewed from an obliquely lower position.

FIGS. 1 and 2 show a connector 11 according to Embodiment 1. The connector 11 is used as, for example, a garment-side connector portion for fitting a wearable device, and is connected to a plurality of flexible conductors 21.

The connector 11 includes a housing 12, a plurality of contacts 13 and a plurality of pushing members 14 that separately hold the plurality of flexible conductors 21, and the plurality of contacts 13 are electrically connected to the plurality of flexible conductors 21 in a one-by-one manner. The housing 12 includes a recess 12A, and in the recess 12A of the housing 12, the contacts 13 project perpendicularly to a flat bottom surface of the recess 12A.

The flexible conductors 21 are disposed to a rear surface 12B of the housing 12 while being separately held by the pushing members 14. The flexible conductors 21 are produced using a conductive yarn formed by twisting a plurality of conductive fibers.

For convenience, the bottom surface of the recess 12A of the housing 12 is defined as extending along an XY plane, and the direction in which the contacts 13 project is referred to as "+Z direction."

As the contacts 13, provided are four pairs of contacts 13 arranged in the X direction, and two contacts 13 in each pair are aligned in the Y direction.

Figure 3:
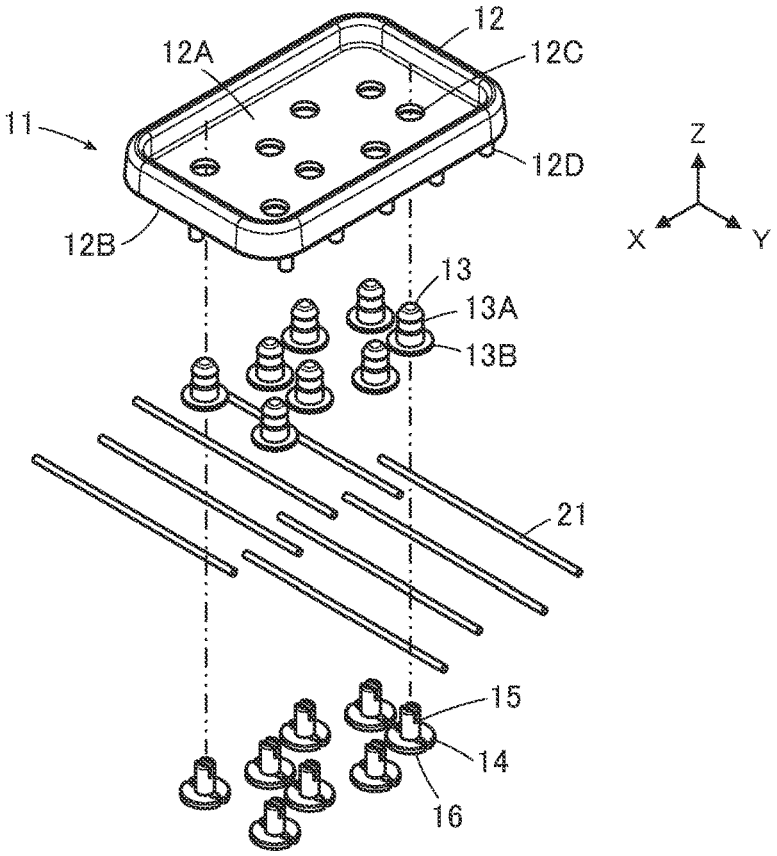
FIG. 3 is an exploded perspective view showing the connector according to Embodiment 1.

The housing 12 is made of an insulating material such as insulating resin and is provided with a plurality of contact through-holes 12C within the recess 12A opening in the +Z direction, as illustrated in FIG. 3. The recess 12A constitutes a counter connector accommodating portion in which part of a counter connector (not shown) is to be accommodated. The plurality of contact through-holes 12C correspond to the plurality of contacts 13 in a one-by-one manner. In addition, a plurality of bosses 12D are formed on the rear surface 12B of the housing 12 on the −Z direction side and project in the −Z direction.

The contacts 13 are plug-type contacts made of a conductive material such as metal, and are to be connected to corresponding contacts of a counter connector (not shown) when part of the counter connector is accommodated in the recess 12A of the housing 12. The contact 13 has a tubular portion 13A in the shape of a cylindrical tube extending in the +Z direction and a contact-side flange 13B extending from the −Z directional end of the tubular portion 13A along an XY plane.

The plurality of pushing members 14 correspond to the plurality of contacts 13, and each pushing member 14 includes a projection 15 extending in the +Z direction and a pushing member-side flange 16 extending from the −Z directional end of the projection 15 along an XY plane.

The contact through-holes 12C of the housing 12, the contacts 13, the flexible conductors 21 and the pushing members 14 are arranged so as to positionally align with each other in the Z direction.

The contact through-holes 12C of the housing 12 have an inside diameter larger than the outside diameter of the tubular portions 13A of the contacts 13 and smaller than the outside diameter of the contact-side flanges 13B, thus allowing smooth insertion of the tubular portions 13A of the contacts 13.

Figure 4:
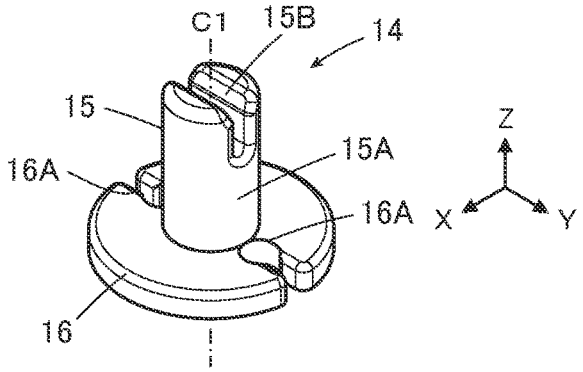
FIG. 4 is a perspective view showing a pushing member used in the connector according to Embodiment 1.

As illustrated in FIG. 4, the projection 15 of the pushing member 14 has a projection body 15A of a substantially columnar shape projecting in the +Z direction along a central axis Cl. The +Z directional tip of the projection body 15A is divided into halves across the central axis C1. Accordingly, the projection 15 is provided at the +Z directional tip thereof with a holding groove 15B that opens in the projecting direction of the projection 15 and extends across the projection 15 in the Y direction perpendicular to the projecting direction.

The holding groove 15B forms a holding portion for holding a middle part of the flexible conductor 21 made of a conductive yarn. The holding groove 15B preferably has a width dimension smaller than the diameter dimension of the flexible conductor 21 since, with such configuration, the flexible conductor 21 can be held in the holding groove 15B by being pushed into the holding groove 15B from the +Z direction. Meanwhile, the holding groove 15B may have a width dimension larger than the diameter dimension of the flexible conductor 21. Even in such a case, the position of the flexible conductor 21 relative to the projection 15 can be maintained.

The pushing member-side flange 16 of the pushing member 14 has a substantially circular disk shape extending from the −Z directional end of the projection 15 along an XY plane and includes a pair of cutouts 16A separately arranged on opposite sides in the Y direction of a root portion (−Z directional end) of the projection 15 across the projection 15. The cutouts 16A form a pair of fixing portions for fixing the flexible conductor 21.

Figure 5:
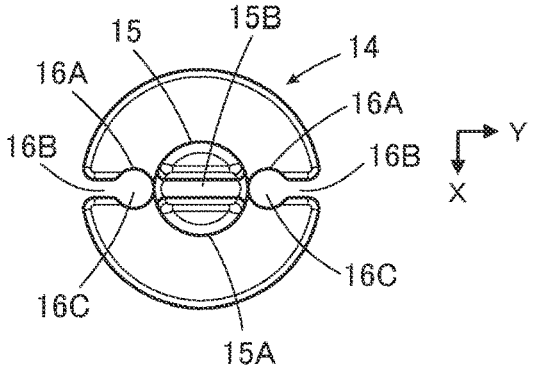
FIG. 5 is a plan view showing the pushing member used in the connector according to Embodiment 1.

As illustrated in FIG. 5, each of the cutouts 16A includes an opening end portion 16B opening toward the outer periphery of the pushing member-side flange 16 and an enlarged portion 16C in a substantially circular shape communicating with the opening end portion 16B and formed to adjoin the root portion of the projection 15. The opening end portion 16B has a smaller width dimension than the diameter of the flexible conductor 21, while the enlarged portion 16C has a larger diameter dimension than the width dimension of the opening end portion 16B. The diameter dimension of the enlarged portion 16C may be larger than the diameter of the flexible conductor 21 or equal to or smaller than the diameter of the flexible conductor 21.

Accordingly, when the flexible conductor 21 is inserted from the opening end portion 16B into the enlarged portion 16C of the cutout 16A, due to the opening end portion 16B having the smaller width dimension than the diameter of the flexible conductor 21, the flexible conductor 21 is prevented from falling off the cutout 16A in the +Y direction or the −Y direction.

As illustrated in FIG. 6, the tubular portion 13A of the contact 13 has the shape of a cylindrical tube with its +Z directional end being closed, the contact-side flange 13B is formed integrally with the −Z directional end of the tubular portion 13A, and a projection accommodating portion 13C of a recess shape is provided in the tubular portion 13A. That is, the contact-side flange 13B is formed so as to surround an opening end portion of the projection accommodating portion 13C.

The contact 13 as above can be manufactured by, for example, press working, cutting or drawing.

Figure 9:
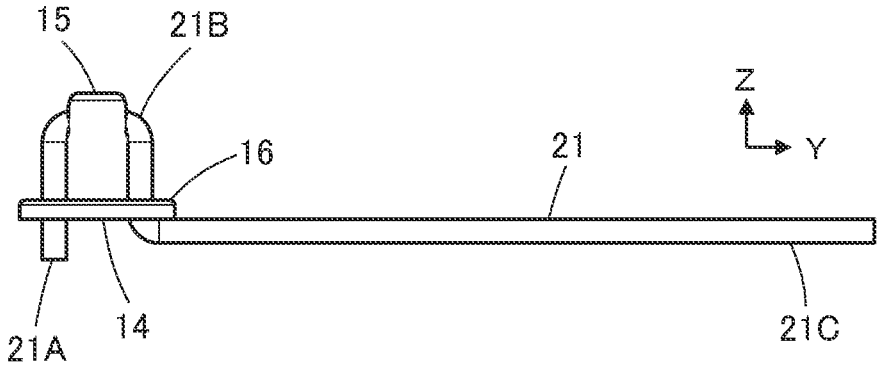
FIG. 9 is a side view showing the pushing member to which the flexible conductor is disposed in Embodiment 1.

For connecting the connector 11 to the plurality of flexible conductors 21, first, as illustrated in FIGS. 7 to 9, each flexible conductor 21 is inserted into the pair of cutouts 16A in the pushing member-side flange 16 of the pushing member 14 and the holding groove 15B of the projection 15, whereby the flexible conductor 21 is held by the corresponding pushing member 14.

In this process, for example, a part near a tip 21A of the flexible conductor 21 is inserted into one of the cutouts 16A of the pushing member-side flange 16 such that the tip 21A projects from the pushing member 14 in the −Z direction, the flexible conductor 21 is laid along a lateral surface of the projection 15, a middle part 21B of the flexible conductor 21 is inserted into the holding groove 15B of the projection 15, and besides, the flexible conductor 21 is inserted into the other one of the cutouts 16A of the pushing member-side flange 16 while being laid along an opposite lateral surface of the projection 15.

The flexible conductor 21 is inserted through the opening end portion 16B to reach the enlarged portion 16C in each of the cutouts 16A illustrated in FIG. 5, whereby the flexible conductor 21 is prevented from falling off the cutouts 16A.

The flexible conductor 21 is inserted into the pair of cutouts 16A to be thereby fixed to the pushing member 14, and the middle part 21B is inserted into the holding groove 15B of the projection 15 so that the position of the flexible conductor 21 relative to the projection 15 is maintained.

The tip 21A of the flexible conductor 21 extends in the −Z direction on the −Z direction side of the pushing member 14, while a base part 21C of the flexible conductor 21 extends in the Y direction in the outside of the pushing member 14.

The flexible conductors 21 are separately held by the corresponding pushing members 14 in this manner.

Figure 10:
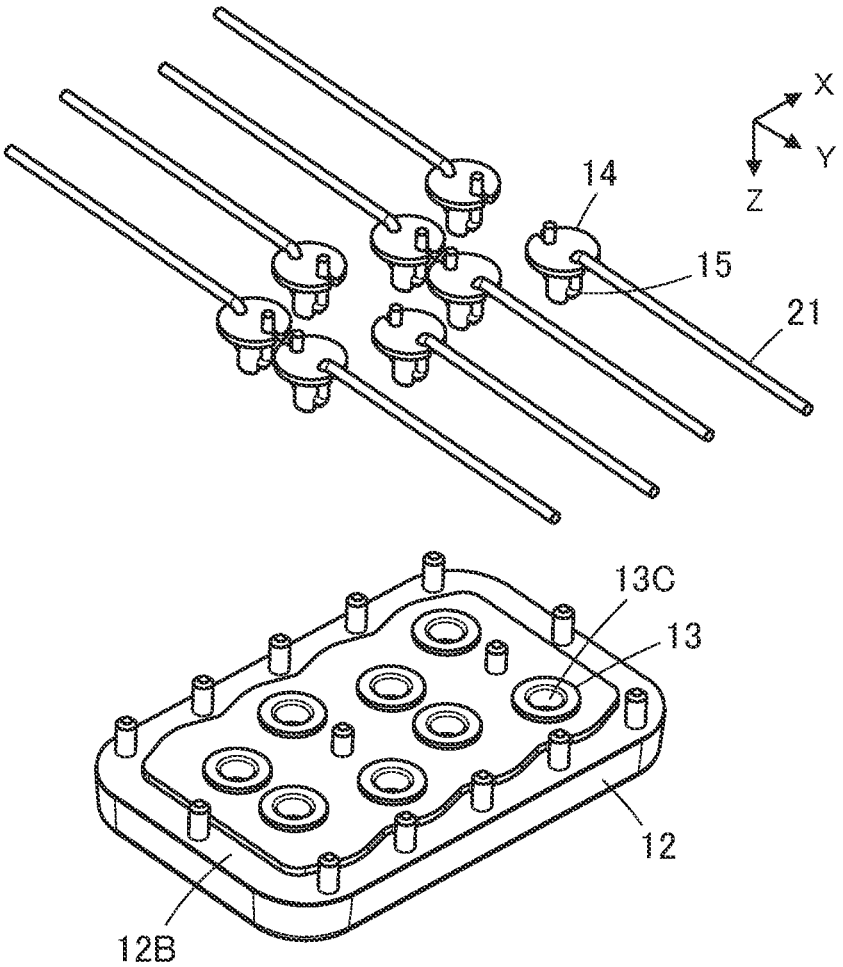
FIG. 10 is a perspective view showing a plurality of pushing members to each of which the flexible conductor is disposed and which are aligned with a plurality of contacts held by a housing.

Next, as illustrated in FIG. 10, the plurality of pushing members 14 each holding the corresponding flexible conductor 21 are aligned with the plurality of contacts 13 arranged in the housing 12 on the −Z direction side of the contacts 13. The pushing members 14 are arranged such that the projections 15 of the pushing members 14 face and project toward the corresponding contacts 13 arranged in the housing 12.

For example, as illustrated in FIG. 10, the housing 12 is placed on a surface of, for instance, a workbench (not shown) with the rear surface 12B facing upward, the tubular portions 13A of the contacts 13 are inserted into the contact through-holes 12C of the housing 12 from above, and the pushing members 14 are arranged above the contacts 13 such that the projections 15 project downward.

In this state, the pushing members 14 are each pressed toward the projection accommodating portion 13C of the corresponding contact 13. Accordingly, the projections 15 of the pushing members 14 are inserted into the projection accommodating portions 13C of the contacts 13 together with the flexible conductors 21, whereby the connector 11 illustrated in FIGS. 1 and 2 is manufactured, and the connection process of connecting the connector 11 to the plurality of flexible conductors 21 is completed.

Figure 11:
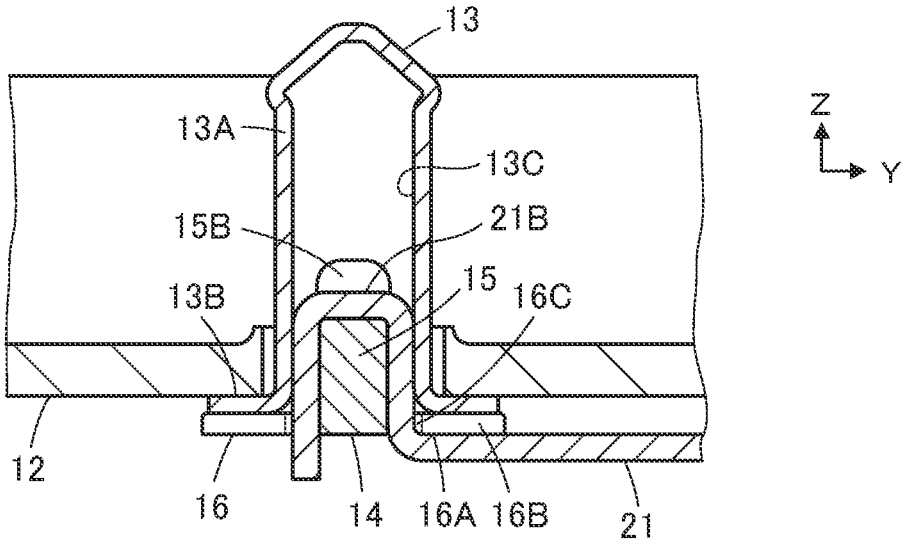
FIG. 11 is a cross-sectional side view showing the contact, the pushing member and the flexible conductor in the connector according to Embodiment 1.

When the projection 15 of each pushing member 14, together with the flexible conductor 21, is inserted into the projection accommodating portion 13C of the corresponding contact 13 as above, of the flexible conductor 21, parts that are situated on opposite sides of and are adjoining the middle part 21B that is inserted in the holding groove 15B of the projection 15 are sandwiched between a lateral surface of the projection 15 and an inner surface of the projection accommodating portion 13C of the contact 13 as illustrated in FIG. 11. Accordingly, the flexible conductor 21 contacts the inner surface of the projection accommodating portion 13C, whereby the contact 13 is electrically connected to the flexible conductor 21.

Since the flexible conductor 21 is inserted into the pair of cutouts 16A of each pushing member 14 so as to be fixed to the pushing member 14, even when the flexible conductor 21 is made of a conductive yarn that is thinner than the projection 15 of the pushing member 14, the position of the flexible conductor 21 is prevented from shifting at the time of insertion of the projection 15 of the pushing member 14 into the projection accommodating portion 13C of the corresponding contact 13. Hence, the contact 13 can be readily connected to the flexible conductor 21 by simply inserting the projection 15 of the pushing member 14 into the projection accommodating portion 13C of the contact 13.

In particular, since the middle part 21B of the flexible conductor 21 is inserted into the holding groove 15B formed at the tip of the projection 15 of the pushing member 14 so that the relative position between the projection 15 and the flexible conductor 21 is maintained, the reliability of electrical connection between the contact 13 and the flexible conductor 21 can be ensured.

While the projection 15 of the pushing member 14 includes the holding groove 15B opening in the projecting direction of the projection 15 as a holding portion for holding the middle part of the flexible conductor 21 in Embodiment 1 described above, a holding hole penetrating the projection body 15A in the Y direction across the projection body 15A, for example, may be used as a holding portion for holding the flexible conductor 21. The flexible conductor 21 is passed through the holding hole to be thereby held by the projection 15.

The connector 11 is preferably provided with a cover member (not shown) that covers the pushing member-side flanges 16 of the plurality of pushing members 14 and the plurality of flexible conductors 21 exposed on the rear surface 12B side of the housing 12 illustrated in FIG. 2. The cover member is made from an insulating material, has a plurality of boss accommodating holes separately corresponding to the plurality of bosses 12D projecting from the rear surface 12B of the housing 12 and can be fixed to the housing 12 by pressing the bosses 12D of the housing 12 into the boss accommodating holes of the cover member. Alternatively, the cover member may be fixed to the housing 12 by thermally deforming the heads of the bosses 12D with the bosses 12D of the housing 12 being passed through the boss accommodating holes of the cover member.

Figure 12:
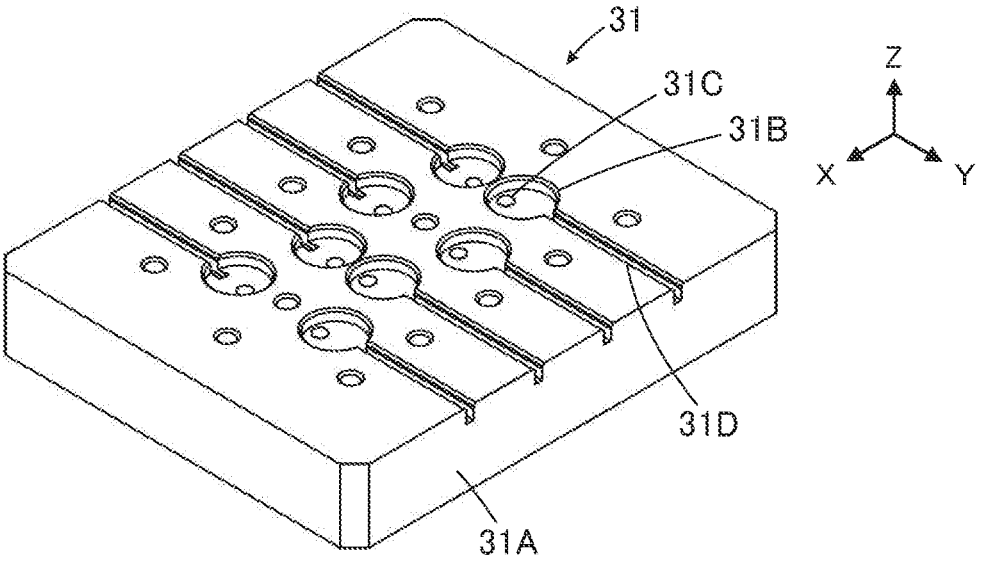
FIG. 12 is a perspective view showing a pushing jig used for assembling a connector according to a variation of Embodiment 1.

While the plurality of pushing members 14 are each inserted into the projection accommodating portion 13C of the corresponding contact 13 together with the flexible conductor 21 in Embodiment 1 described above, the pushing members 14 can be inserted into the projection accommodating portions 13C of the plurality of contacts 13 at a time with use of, for example, a pushing jig 31 as illustrated in FIG. 12.

In FIG. 12, the pushing jig 31 includes a jig body 31A of a flat plate shape and a plurality of pushing member-side flange fitting portions 31B formed on a front surface of the jig body 31A. Each pushing member-side flange fitting portion 31B has a substantially same size as that of the pushing member-side flange 16 of the pushing member 14 so that the pushing member-side flange 16 can be readily fitted into the corresponding pushing member-side flange fitting portion 31B to temporarily fix the pushing member 14 to the pushing jig 31. In addition, the pushing member 14 temporarily fixed to the pushing jig 31 can be readily detached from the pushing jig 31 by pulling the pushing member 14 out.

In addition, a flexible conductor accommodating hole 31C is formed in each of the pushing member-side flange fitting portions 31B, and a plurality of flexible conductor accommodating grooves 31D are formed on a surface of the jig body 31A, each of which flexible conductor accommodating grooves 31D extends from the pushing member- side flange fitting portion 31B to an edge portion of the jig body 31A in the Y direction. The flexible conductor accommodating hole 31C is to accommodate the tip 21A of the flexible conductor 21 held by the pushing member 14, and the flexible conductor accommodating groove 31D is to accommodate the base part 21C of the flexible conductor 21 held by the pushing member 14.

For connecting the plurality of contacts 13 to the plurality of flexible conductors 21 with use of the pushing jig 31, first, the pushing member-side flanges 16 of the pushing members 14 each holding the corresponding flexible conductor 21 are separately fitted into the pushing member-side flange fitting portions 31B of the pushing jig 31, whereby the pushing members 14 are temporarily fixed to the pushing jig 31. At this time, of the flexible conductor 21 held by each pushing member 14, the tip 21A projecting in the −Z direction is accommodated in the corresponding flexible conductor accommodating hole 31C of the pushing jig 31, and the base part 21C extending in the Y direction is accommodated in the corresponding flexible conductor accommodating groove 31D of the pushing jig 31.

Figure 13:
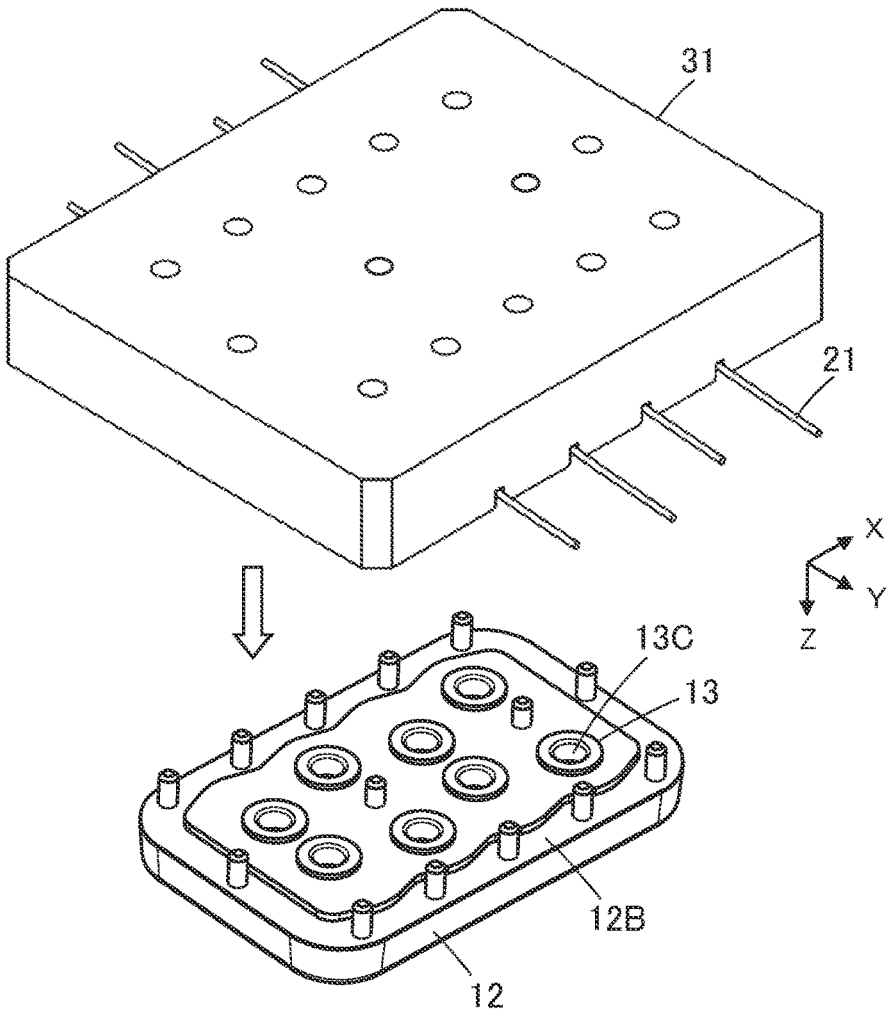
FIG. 13 is a perspective view showing the pushing jig by which a plurality of pushing members and a plurality of flexible conductors are temporarily held, the pushing jig being pushed toward a housing which holds a plurality of contacts in the variation of Embodiment 1.

Next, as illustrated in FIG. 13, the housing 12 is placed on a surface of, for instance, a workbench (not shown) with the rear surface 12B facing upward, the tubular portions 13A of the contacts 13 are inserted into the contact through-holes 12C of the housing 12 from above, and in this state, the pushing jig 31 is pressed against the housing 12 from above such that the projections 15 of the pushing members 14 temporarily fixed to the pushing jig 31 face and project downward. Accordingly, the projections 15 of the pushing members 14 temporarily fixed to the pushing jig 31 are inserted into the projection accommodating portions 13 of the contacts 13 together with the flexible conductors 21 at a time, and the plurality of contacts 13 are electrically connected to the plurality of flexible conductors 21 in a one-by-one manner.

Thereafter, the pushing jig 31 is detached from the pushing members 14, whereby the connector 11 illustrated in FIGS. 1 and 2 is produced.

Figure 14:
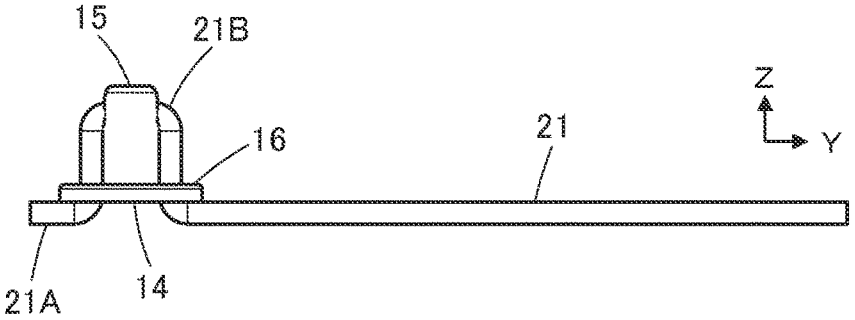
FIG. 14 is a side view showing a pushing member to which a flexible conductor is disposed in another variation of Embodiment 1.

While the tip 21A of the flexible conductor 21 held by the pushing member 14 extends in the −Z direction on the −Z direction side of the pushing member 14 in Embodiment 1 as illustrated in FIG. 9, the invention is not limited thereto. For instance, as illustrated in FIG. 14, the tip 21A of the flexible conductor 21 may be bent on the −Z direction side of the pushing member 14 so as to extend in the −Y direction that is the opposite direction from the base part 21C.

With such configuration, the tip 21A of the flexible conductor 21 does not extend from the pushing member 14 in the −Z direction so that the cover member that is not shown can be readily attached to the rear surface 12B of the housing 12.

Embodiment 2

Figure 15:
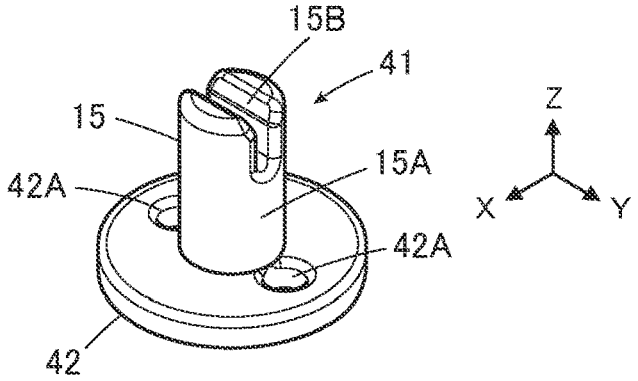
FIG. 15 is a perspective view showing a pushing member used in a connector according to Embodiment 2.

While the pushing member 14 illustrated in FIGS. 4 and 5 includes the pair of cutouts 16A as a pair of fixing portions for fixing the flexible conductor 21, the invention is not limited thereto. For instance, as exemplified by a pushing member 41 illustrated in FIG. 15, a pair of through-holes 42A can be formed in a pushing member-side flange 42 and used as a pair of fixing portions. The pushing member 41 utilizes the pushing member-side flange 42 having the pair of through-holes 42A in place of the pushing member-side flange 16 having the pair of cutouts 16A in the pushing member 14 illustrated in FIGS. 4 and 5 and, except this difference, has the same configuration as that of the pushing member 14 in Embodiment 1.

More specifically, the pushing member-side flange 42 of a substantially circular disk shape extends from the −Z directional end of the projection 15 along an XY plane and is provided with the pair of through-holes 42A that are situated on opposite sides in the Y direction of and adjoin a root portion (−Z directional end) of the projection 15 across the projection 15. The through-holes 42A have a larger diameter than the diameter of the flexible conductor 21.

Figure 16:
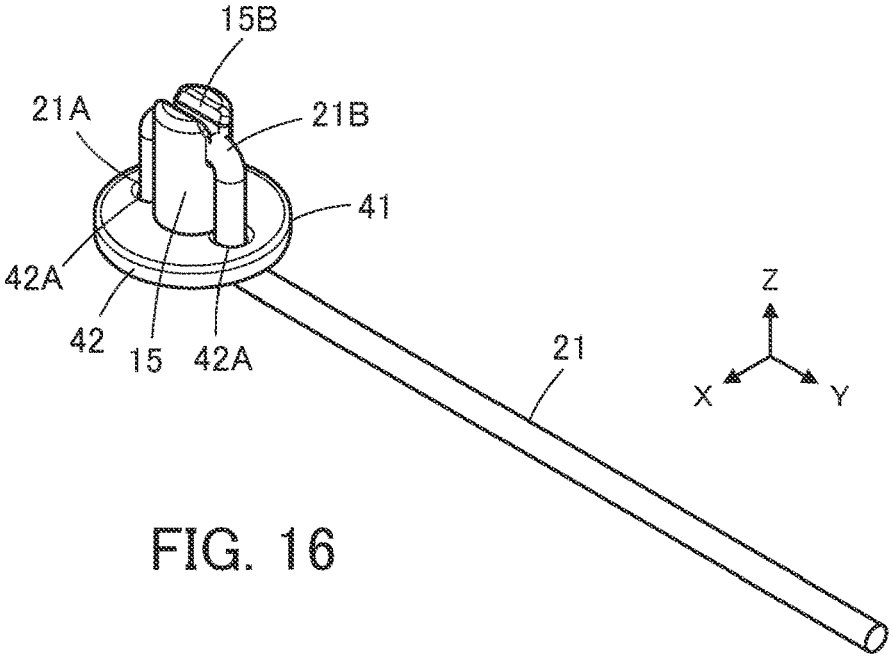
FIG. 16 is a perspective view showing the pushing member to which a flexible conductor is disposed in Embodiment 2.

As illustrated in FIG. 16, the flexible conductor 21 is passed through the pair of through-holes 42A in the pushing member-side flange 42 of the pushing member 41 and inserted into the holding groove 15B of the projection 15, thereby being held by the pushing member 41.

In this process, for example, the tip 21A of the flexible conductor 21 is passed through one of the through-holes 42A of the pushing member-side flange 42 such that the tip 21A projects from the pushing member 41 in the −Z direction, the flexible conductor 21 is laid along a lateral surface of the projection 15, the middle part 21B of the flexible conductor 21 is inserted into the holding groove 15B of the projection 15, and besides, the flexible conductor 21 is passed through the other one of the through-holes 42A of the pushing member-side flange 42 while being laid along an opposite lateral surface of the projection 15.

The flexible conductor 21 is passed through the pair of through-holes 42A of the pushing member-side flange 42 to be thereby fixed to the pushing member 41, and the middle part 21B is inserted into the holding groove 15B of the projection 15 so that the position of the flexible conductor 21 relative to the projection 15 is maintained.

Even with use of the pushing member 41, the contact 13 can be readily connected to the flexible conductor 21, and the reliability of electrical connection between the contact 13 and the flexible conductor 21 can be ensured, as with Embodiment 1.

Figure 17:
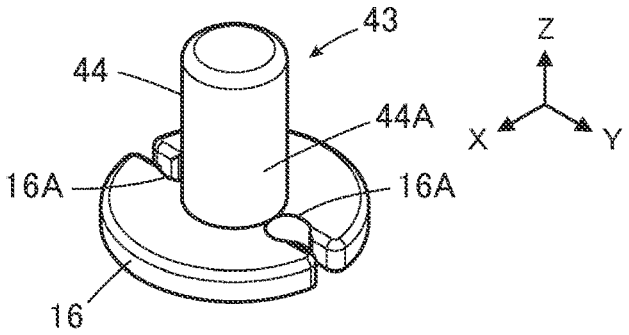
FIG. 17 is a perspective view showing a pushing member used in a connector according to a variation of Embodiment 2.

Alternatively, a pushing member 43 illustrated in FIG. 17 may be used. The pushing member 43 uses a projection 44 having no holding groove in the pushing member 14 illustrated in FIGS. 4 and 5 in place of the projection 15 having the holding groove 15B at its tip and, except this difference, has the same configuration as that of the pushing member 14 in Embodiment 1.

More specifically, the projection 44 of the pushing member 43 includes a projection body 44A of a columnar shape projecting in the +Z direction, and the pushing member-side flange 16 of a substantially circular disk shape extends from the −Z directional end of the projection 44 along an XY plane. The projection 44 has no holding groove, and the +Z directional tip of the projection body 44A forms a flat surface extending along an XY plane. The pushing member-side flange 16 includes the pair of cutouts 16A arranged on opposite sides in the Y direction of a root portion (−Z directional end) of the projection 44 across the projection 44.

Figure 18:
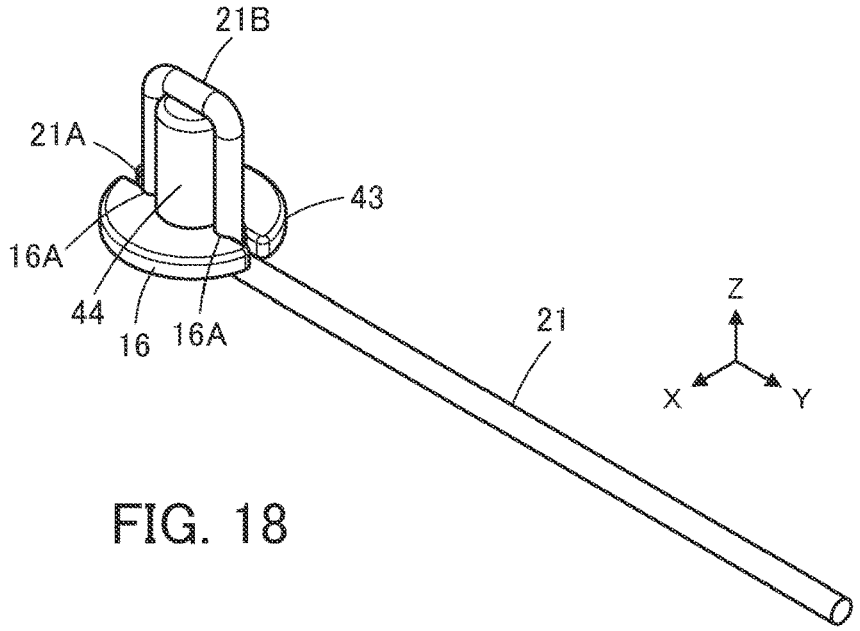
FIG. 18 is a perspective view showing the pushing member to which the flexible conductor is disposed in the variation of Embodiment 2.

As illustrated in FIG. 18, the flexible conductor 21 is inserted into the pair of cutouts 16A in the pushing member-side flange 16 of the pushing member 43, thereby being held by the pushing member 43.

In this process, for example, a part near the tip 21A of the flexible conductor 21 is inserted into one of the cutouts 16A of the pushing member-side flange 16 such that the tip 21A projects from the pushing member 43 in the −Z direction, the flexible conductor 21 is laid along a lateral surface of the projection 44, the middle part 21B of the flexible conductor 21 is placed on the flat surface formed at the +Z directional tip of the projection body 44A, and besides, the flexible conductor 21 is inserted into the other one of the cutouts 16A of the pushing member-side flange 16 while being laid along an opposite lateral surface of the projection 44.

The flexible conductor 21 is inserted into the pair of cutouts 16A of the pushing member-side flange 16, thereby being fixed to the pushing member 43.

Even with use of the pushing member 43, the contact 13 can be readily connected to the flexible conductor 21, as with Embodiment 1.

Meanwhile, in the pushing member 14 in Embodiment 1, the position of the flexible conductor 21 relative to the projection 15 is maintained since the middle part 21B of the flexible conductor 21 is inserted into the holding groove 15B of the projection 15, and therefore, the pushing member 14 having the projection 15 provided with the holding groove 15B is more advantageous than the pushing member 43 illustrated in FIG. 17 in terms of improvement in the reliability of electrical connection between the contact 13 and the flexible conductor 21.

Figure 19:
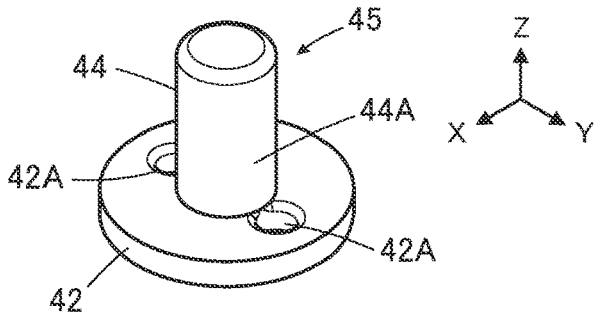
FIG. 19 is a perspective view showing a pushing member used in a connector according to another variation of Embodiment 2.

In addition, as illustrated in FIG. 19, a pushing member 45 including the projection 44 having the projection body 44A of a columnar shape provided with no holding groove and the pushing member-side flange 42 provided with the pair of through-holes 42A may be used.

The flexible conductor 21 is passed through the pair of through-holes 42A of the pushing member-side flange 42 to be thereby fixed to the pushing member 45, and the middle part 21B of the flexible conductor 21 is placed on the flat surface formed at the +Z directional tip of the projection body 44A.

Even with use of the pushing member 45, the contact 13 can be readily connected to the flexible conductor 21, as with Embodiment 1.

Embodiment 3

While contact 13 is connected to the flexible conductor 21 made of a conductive yarn in Embodiments 1 and 2 above, the invention can be applied to a flexible conductor made of a sheet-like or band-like conductor.

Figure 20:
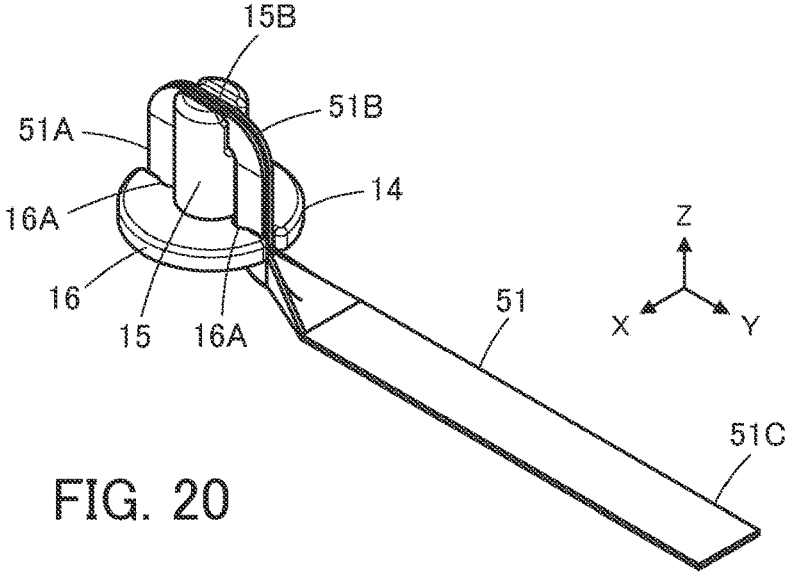
FIG. 20 is a perspective view showing a pushing member to which a flexible conductor is disposed in Embodiment 3.

As illustrated in FIGS. 20 and 21, a flexible conductor 51 made of a band-like conductor can be held by the pushing member 14 used in Embodiment 1. Of the flexible conductor 51, a part from a tip 51A to a middle part 51B and a part having a predetermined length from the middle part 51B toward a base part 51C are folded in halves along the center line in the length direction of the flexible conductor 51.

The folded flexible conductor 51 is inserted into each of the pair of cutouts 16A in the pushing member-side flange 16 of the pushing member 14, whereby the flexible conductor 51 is fixed to the pushing member 14, and the folded middle part 51B of the flexible conductor 51 is inserted into the holding groove 15B of the projection 15 of the pushing member 14, whereby the position of the projection 15 relative to the flexible conductor 51 is maintained.

In this state, the projection 15 of the pushing member 14 together with the flexible conductor 51 is inserted into the projection accommodating portion 13C of the contact 13 illustrated in FIG. 6, and the folded parts of the flexible conductor 51 that are situated on opposite sides of and are adjoining the middle part 51B of the flexible conductor 51 are sandwiched between a lateral surface of the projection 15 and an inner surface of the projection accommodating portion 13C of the contact 13. Accordingly, the flexible conductor 51 contacts the inner surface of the projection accommodating portion 13C, whereby the contact 13 is electrically connected to the flexible conductor 51.

Since the folded flexible conductor 51 is inserted into the pair of cutouts 16A so that the flexible conductor 51 is fixed to the pushing member 14, the relative position of the flexible conductor 51 is prevented from shifting at the time of insertion of the projection 15 of the pushing member 14 into the projection accommodating portion 13C of the corresponding contact 13. Hence, the contact 13 can be readily connected to the band-like flexible conductor 51 by simply inserting the projection 15 of the pushing member 14 into the projection accommodating portion 13C of the corresponding contact 13.

Alternatively, the flexible conductor 51 made of a band-like conductor can be held by the pushing member 43 having the projection 44 with no holding groove as illustrated in FIG. 17. In this case, as illustrated in FIGS. 22 and 23, the middle part 51B of the flexible conductor 51 is not folded in halves and is placed on the +Z directional end surface of the projection 44 of the pushing member 43, and only parts of the flexible conductor 51 corresponding to the pair of cutouts 16A of the pushing member-side flange 16 of the pushing member 43 are folded in halves and inserted into the pair of cutouts 16A.

The flexible conductor 51 being folded in halves is inserted into the pair of cutouts 16A of the pushing member-side flange 16 of the pushing member 43, whereby the flexible conductor 51 is fixed to the pushing member 43.

In this state, the projection 44 of the pushing member 43 together with the flexible conductor 51 is inserted into the projection accommodating portion 13C of the contact 13 illustrated in FIG. 6, and parts of the flexible conductor 51 that are situated on opposite sides of and are adjoining the middle part 51B of the flexible conductor 51 are sandwiched between a lateral surface of the projection 44 and an inner surface of the projection accommodating portion 13C of the contact 13. Accordingly, the flexible conductor 51 contacts the inner surface of the projection accommodating portion 13C, whereby the contact 13 is electrically connected to the flexible conductor 51.

Since the folded parts of the flexible conductor 51 are inserted into the pair of cutouts 16A so that the flexible conductor 51 is fixed to the pushing member 43, the relative position of the flexible conductor 51 is prevented from shifting at the time of insertion of the projection 44 of the pushing member 43 into the projection accommodating portion 13C of the corresponding contact 13. Hence, the contact 13 can be readily connected to the band- like flexible conductor 51 by simply inserting the projection 44 of the pushing member 43 into the projection accommodating portion 13C of the corresponding contact 13.

Embodiment 4

Figure 24:
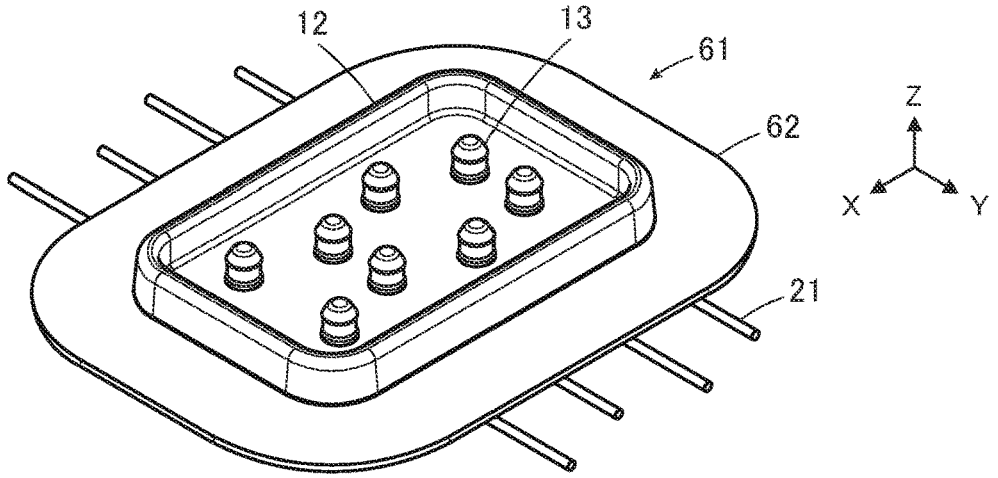
FIG. 24 is a perspective view showing a connector according to Embodiment 4.

FIG. 24 shows a connector 61 according to Embodiment 4. The connector 61 has the same configuration as that of the connector 11 according to Embodiment 1 illustrated in FIG. 1 except that a connector fixing member 62 of a sheet shape is disposed between the housing 12 and the plurality of flexible conductors 21 in the connector 11 according to Embodiment 1.

The connector fixing member 62 is made of insulating resin or cloth and extends to the outside of the housing 12 so as to seamlessly surround the outer periphery of the housing 12.

The connector fixing member 62 includes a plurality of through-holes (not shown) corresponding to the plurality of bosses 12D of the housing 12, and by pressing the bosses 12D separately into the through-holes, the connector fixing member 62 is held by the housing 12.

The connector 61 can be attached to a garment by sewing the circumferential edge of the connector fixing member 62 on the outside of the housing 12 to cloth of the garment using, for example, an insulating thread.

Embodiment 5

Figure 25:
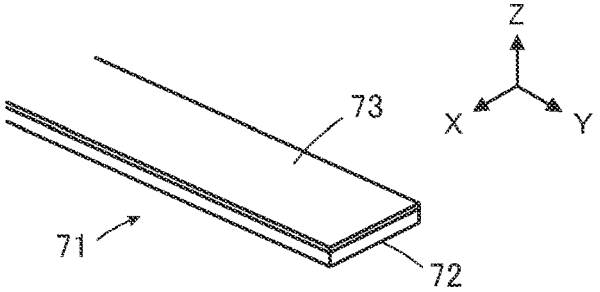
FIG. 25 is a perspective view showing a flexible conductor to which a connector according to Embodiment 5 is connected.
Figure 26:
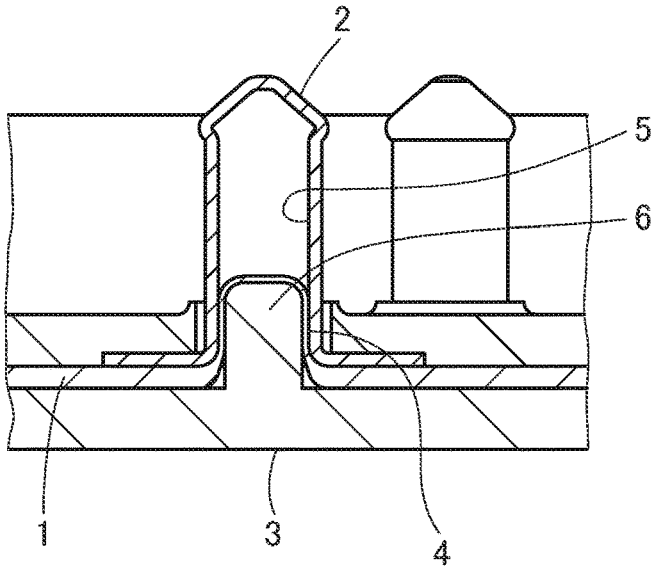
FIG. 26 PRIOR ART
FIG. 26 is a cross-sectional view showing a contact, a projection and a flexible substrate in a conventional connector.

In Embodiments 1 to 4 described above, the flexible conductor 21 made of a conductive yarn or the flexible conductor 51 made of a band-like conductor is not supported by, for example, an insulating substrate body but is independently disposed between the projection 15, 44 of the pushing member 14, 41, 43, 45 and the contact 13. However, the invention is not limited thereto. The connector according to the invention can be connected to a flexible substrate 71 as illustrated in FIG. 25.

The flexible substrate 71 has a flexible conductor 73 disposed to be exposed on a top surface of a sheet-like substrate body 72 made of an insulating material.

For connecting the connector to the foregoing flexible substrate 71, the flexible substrate 71 is disposed such that the flexible conductor 73 faces the inner surface of the projection accommodating portion 13C of the contact 13 while a bottom surface of the substrate body 72 faces a lateral surface of the projection 15, 44 of the pushing member 14, 41, 43, 45. In this manner, the contact 13 can be electrically connected to the flexible conductor 73 as with Embodiments 1 to 4.

While the plug-type contacts 13 are used in the above-described Embodiments 1 to 5, the invention is not limited thereto, and it is also possible to similarly configure a connector in which receptacle-type contacts are connected to the flexible conductors 21, 51, 73.

What is claimed is:

1. A connector to be connected to a flexible conductor, the connector comprising:

a pushing member including a projection and a pushing member-side flange formed at a root portion of the projection; and a contact made of a conductive material and having a projection accommodating portion of a recess shape into which the projection is inserted, wherein the pushing member-side flange includes a pair of fixing portions separately arranged on opposite sides of the root portion of the projection across the projection and used to fix the flexible conductor, and wherein, when the projection is inserted into the projection accommodating portion of the contact together with the flexible conductor with a part of the flexible conductor being laid along a lateral surface of the projection which adjoins the pair of fixing portions and being fixed by the pair of fixing portions, the part of the flexible conductor laid along the lateral surface of the projection is sandwiched between the lateral surface of the projection and an inner surface of the projection accommodating portion to contact the inner surface of the projection accommodating portion, whereby the contact is electrically connected to the flexible conductor wherein each of the pair of fixing portions is constituted of one of a cutout and a through-hole formed in the pushing member-side flange and into which the flexible conductor is inserted.

2. The connector according to claim 1, wherein the projection includes a holding portion extending across the projection in a direction orthogonal to a projecting direction of the projection and used to hold the flexible conductor.

3. The connector according to claim 1, wherein the contact has a tubular portion and a contact-side flange formed at one end of the tubular portion, and wherein, when the projection is inserted into the projection accommodating portion of the contact together with the flexible conductor, the pushing member-side flange and the contact-side flange are superposed on each other.

4. The connector according to claim 1, wherein the flexible conductor is independently disposed on the pushing member.

5. The connector according to claim 1, wherein the flexible conductor is disposed to be exposed on a top surface of an insulating substrate body, and wherein the flexible conductor is disposed on the pushing member such that the flexible conductor faces the inner surface of the projection accommodating portion while a bottom surface of the insulating substrate body faces the lateral surface of the projection.

6. The connector according to claim 1, wherein the contact is a plug-type contact.

7. The connector according to claim 1, wherein the contact is a receptacle-type contact.

8. A connecting method for connecting a contact to a flexible conductor, the method comprising:

fixing a part of the flexible conductor to a pair of fixing portions arranged on opposite sides of a root portion of a projection of a pushing member with the part of the flexible conductor being laid along a lateral surface of the projection, each of the pair of fixing portions being constituted of one of a cutout and a through-hole formed in a pushing member-side flange of the pushing member and into which the flexible conductor is inserted; and inserting the projection into a projection accommodating portion of a recess shape of the contact together with the flexible conductor, whereby, the part of the flexible conductor laid along the lateral surface of the projection is sandwiched between the lateral surface of the projection and an inner surface of the projection accommodating portion to contact the inner surface of the projection accommodating portion, whereby the contact is electrically connected to the flexible conductor.

9. The connecting method according to claim 8, the method further comprising:

temporarily fixing a plurality of the pushing members to a pushing jig of a flat plate shape;

fixing the part of the flexible conductor to the pair of fixing portions of each of the pushing members with the part of the flexible conductor being laid along the lateral surface of the projection of the corresponding one of the pushing members;

pressing the pushing jig against a housing holding a plurality of the contacts to insert each of the projections of the pushing members into the projection accommodating portion of a corresponding one of the contacts together with a corresponding one of the flexible conductors; and detaching the pushing jig from the plurality of the pushing members.

* * * * *